US007305733B2

(12) United States Patent
D'Aguanno

(10) Patent No.: US 7,305,733 B2
(45) Date of Patent: Dec. 11, 2007

(54) GOLF CLUB HEAD GROOVE CLEANING TOOL

(75) Inventor: Francis D. D'Aguanno, Feasterville, PA (US)

(73) Assignee: D & H Golf Enterprises, Inc., North Wales, PA (US)

( * ) Notice: Subject to any disclaimer, the term of this patent is extended or adjusted under 35 U.S.C. 154(b) by 597 days.

(21) Appl. No.: 10/656,409

(22) Filed: Sep. 5, 2003

(65) Prior Publication Data

US 2004/0045113 A1 Mar. 11, 2004

Related U.S. Application Data

(63) Continuation-in-part of application No. 29/163,769, filed on Jul. 12, 2002, now Pat. No. Des. 481,776.

(60) Provisional application No. 60/408,453, filed on Sep. 5, 2002.

(51) Int. Cl.
*A47L 13/08* (2006.01)

(52) U.S. Cl. ..... 15/236.01; 15/185; 30/153

(58) Field of Classification Search ..... 15/185, 15/236.01, 236.05, 236.06, 236.07, 236.08, 15/236.09; 30/153, 255; 7/128; 81/177.6, 81/177.7, 427.5

See application file for complete search history.

(56) References Cited

U.S. PATENT DOCUMENTS

| | | | | | |
|---|---|---|---|---|---|
| 416,526 | A | * | 12/1889 | Warren | 7/118 |
| 586,849 | A | * | 7/1897 | Ibelli | 7/119 |
| 766,247 | A | * | 8/1904 | Heilrath | 15/185 |
| 905,886 | A | * | 12/1908 | Kinney | 15/185 |
| 2,106,584 | A | * | 1/1938 | Whiting | 131/246 |
| 2,857,608 | A | * | 10/1958 | Schwartz | 15/111 |
| D212,712 | S | * | 11/1968 | Godfrey | D21/793 |
| 4,482,263 | A | * | 11/1984 | Palamara | 401/191 |
| 5,007,129 | A | * | 4/1991 | Hainey | 15/236.08 |
| 5,382,107 | A | * | 1/1995 | Nian | 401/191 |
| D476,546 | S | * | 7/2003 | Ping | D8/107 |

* cited by examiner

*Primary Examiner*—Randall Chin
(74) *Attorney, Agent, or Firm*—Synnestvedt & Lechner LLP; Gregory S. Bernabeo, Esq.

(57) ABSTRACT

A foldable hand tool for use with cleaning golf club heads which has an open position and a closed position. The tool has a first section having a first inner side; a second section having a second inner side; and a connector section. The connector section is connected pivotably to the first section at a first connection point, and the connector section is connected pivotably to the second section at a second connection point. The first connection point and the second connection point are spaced from one another and positioned such that the first inner side of the first section is capable of contacting the second inner side of the second section when the tool is in the closed position.

20 Claims, 2 Drawing Sheets

FIG.1A
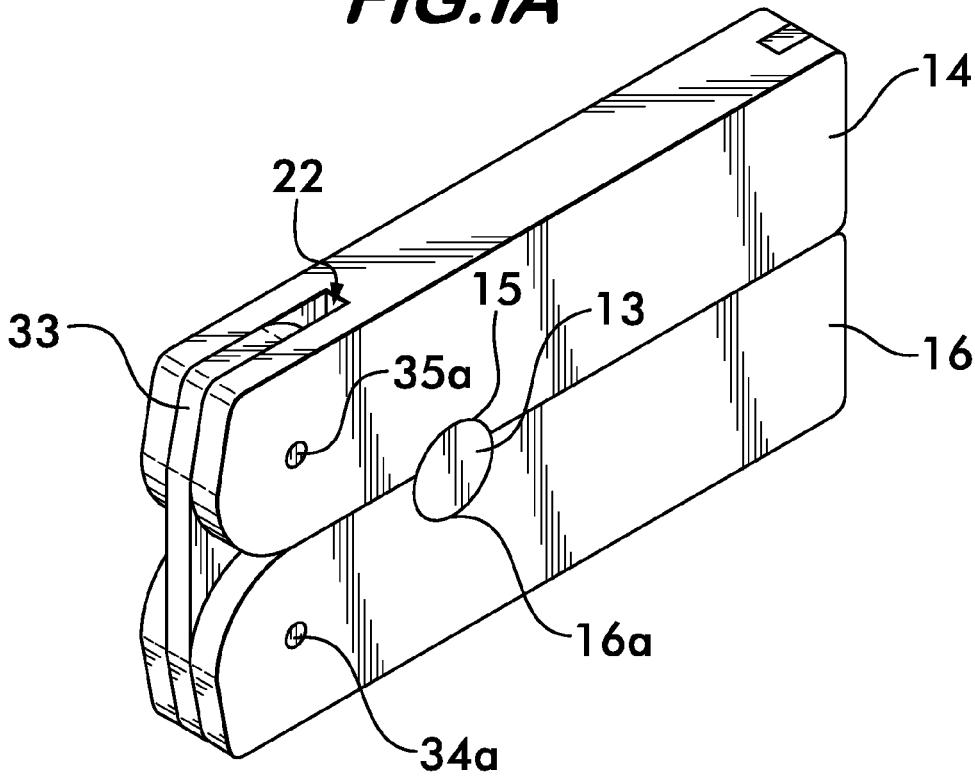
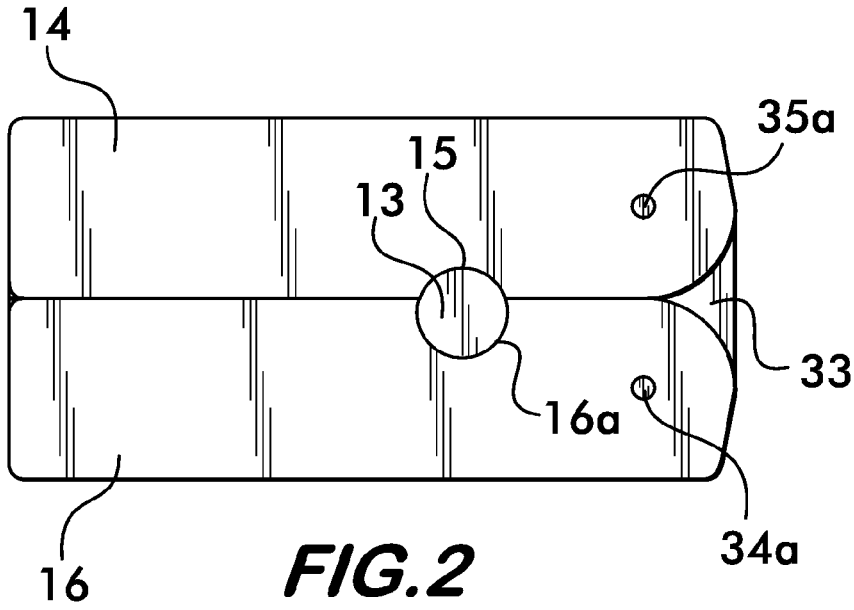
FIG.2

10
12
13
14
15
16
16a
20
21
22
23
25
27
28
29
33
34
34a
35
35a
36
37
38
A
B

GOLF CLUB HEAD GROOVE CLEANING TOOL

RELATED APPLICATION

This application claims the benefit of U.S. Provisional Application No. 60/408,453 filed Sep. 5, 2002 and is a continuation-in-part of U.S. patent application Ser. No. 29/163,769 filed on Jul. 12, 2002 now U.S. Pat. No. D,481,776. The above two identified applications, No. 60/408,453 and Ser. No. 29/163,769, are hereby incorporated herein by reference.

FIELD OF THE INVENTION

The present invention relates to hand tools, and, more particularly, to a foldable hand tool for cleaning and reconditioning the grooves on the face of a golf club head.

BACKGROUND OF THE INVENTION

Small portable hand tools are used for many various applications. Pocket knives, box cutters, and screw drivers are a few examples of such tools. Tools of this type can be used to perform a multitude of tasks.

The sport of golf has become extremely popular over the past several years. As the sport has grown in popularity, golf equipment has advanced as well in an effort to allow the players to achieve the best result for their individual ability level.

Golf clubs are designed such that the face that strikes the golf ball is angled. The angled face of the club causes the ball to be lifted upon impact. A set of golf clubs has clubs with various angles applied to the club faces. A club is selected with a particular angled face according to the trajectory desired (i.e., amount of loft) for a particular golf shot. Golf clubs are numbered, with the lower numbered clubs having a smaller angle (i.e., the club face is angled less relative to the club shaft), with the angle of the club face increasing as the club number increases.

When an angled golf club face contacts a golf ball, it is important that the ball does not slip or skid across the club face. To prevent this from happening, the face of the club head has a series of cuts or grooves on it that typically extend across the club face horizontally. These grooves grip the ball upon impact and impart a rotation to ball. The grooves on the club face help a golfer to control the spin or rotation of the ball and to control the trajectory or loft of the shot, which is critical to accurate placement of a golf shot.

Golfers often play under many conditions that tend to cause the club heads to become soiled, such as wet surfaces, sand, tall grass, dirt, and mud. This can cause a build-up of dirt, grass, or debris on the face of the golf club. This can impair the performance of the club by filling the grooves in the club face, which minimizes or eliminates their ability to function as designed. In addition, as golf clubs become older, constant use begins to cause a wearing away of the grooves. This results from repeated impact with golf balls that over time cause the grooves to become less pronounced.

The degradation of the grooves in the club face either by contamination or wear causes a reduction in the effectiveness of the club to impart the desired rotation on the golf ball, which results in the golfer having less control over the shot. Accordingly, there is a need for a device that can clean and recondition the golf club.

Apparatuses for cleaning golf club heads currently exist. These usually entail the use of wire brushes, water, and large containers. Portable club cleaners have been used, but these devices are still larger than desired and often cause damage to the golf bag they are carried in because they contain sharp edges or areas that can catch or tear on the golf bag material, or the pocket of the golfer carrying the device.

What is desired is a portable tool that can be used to clean or recondition the face of a golf club head and which folds into a compact, smooth configuration when not in use. It is also desirable to provide a hand tool having a novel means of folding. The present invention fulfills this need among others.

SUMMARY OF THE INVENTION

The present invention provides for a foldable hand tool that collapses into a compact folded configuration when not in use. Specifically, in one preferred embodiment, the tool is a device that can clear dirt and debris from the grooves on the club head face. It may, if desired, also allow a golfer to recondition worn grooves to restore them to their original condition.

In a preferred embodiment, the device comprises a first section having a first inner side, a second section having a second inner side; and a connector section, said connector section connected pivotably to said first section at a first connection point, and said connector section connected pivotably to said second section at a second connection point, wherein said first connection point and said second connection point are spaced from one another and positioned such that said first inner side of said first section is capable of contacting said second inner side of said second section when said tool is in the closed position.

The device is unfolded for use. In the unfolded position, the handle is straight and easily capable of being gripped by the golfer. A protruding member is exposed on one end to use to clean or recondition the grooves in the club head face. The protruding member of the device is inserted in the grooves in the head of a golf club, and the device is used for cleaning or reconditioning as desired.

In the closed position, the protruding member is encapsulated within the handle, thus preventing unwanted damage to the golfer's pocket or golf bag during the round of golf. The device folds into a compact unit that is one-half the length of the device during operation. This allows for convenient carrying of the device in the pocket or bag of the golfer. An alignment member is affixed to the second section and a recess is formed on the first section, wherein said recess cooperates with the alignment member to assure proper alignment of the first section and the second section when the device is in the closed position.

BRIEF DESCRIPTION OF THE DRAWINGS

The foregoing summary, as well as the following detailed description will be better understood when read in conjunction with the figures appended hereto. For the purpose of illustrating the invention, there is shown in the drawings a preferred embodiment. It is understood, however, that this invention is not limited to the precise arrangement and instrumentalities shown.

FIG. 1*a* is a perspective view of a golf club head groove cleaning tool in accordance with a preferred embodiment of the present invention, shown in the folded position.

FIG. 2 is a front view of the golf club head groove cleaning tool of FIG. 1*a*, shown in the folded position.

DETAILED DESCRIPTION OF THE INVENTION

Figures 1B, 3:
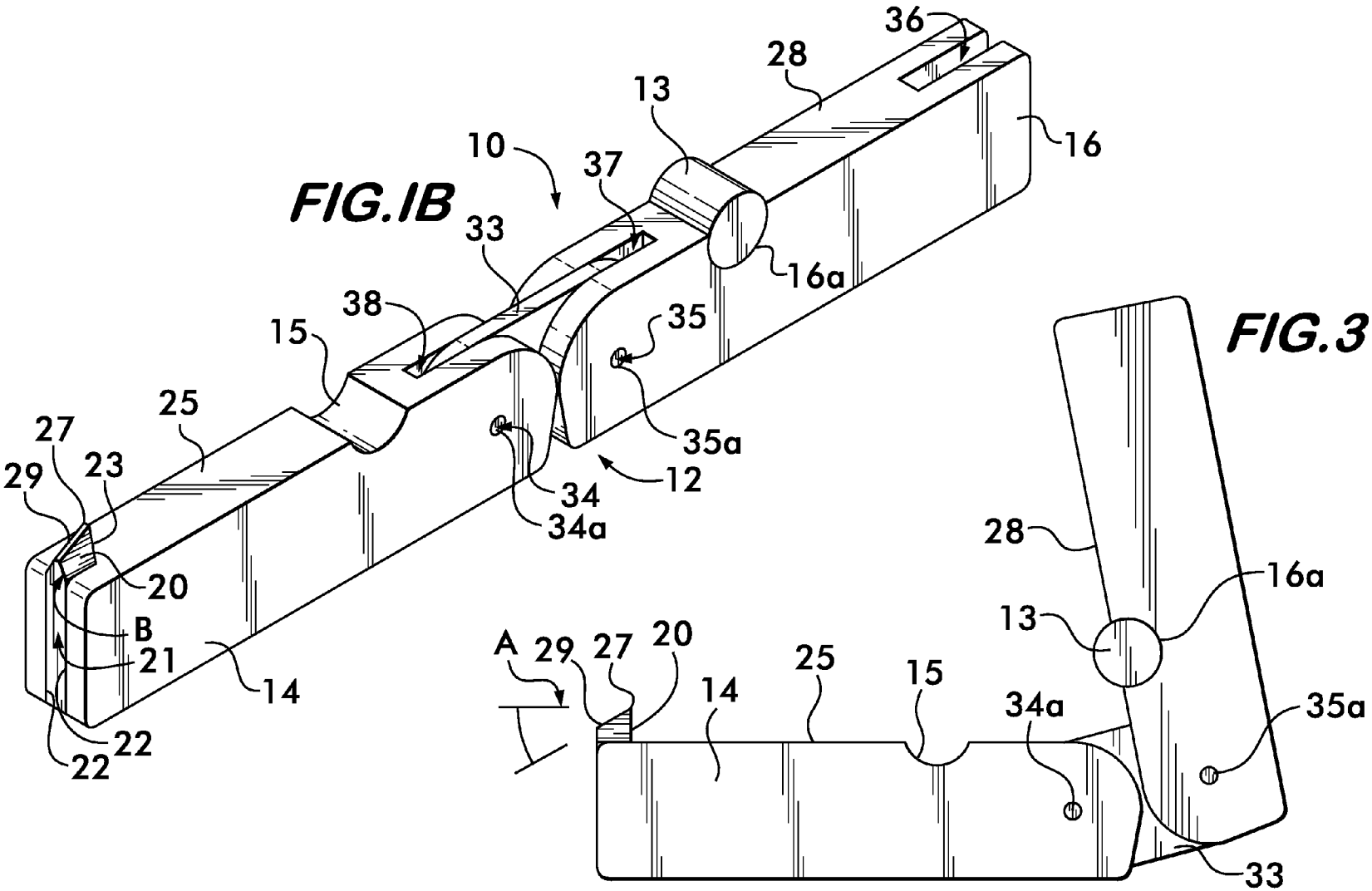
FIG. 1*b* is a perspective view of the golf club head groove cleaning tool of FIG. 1*a*, shown in the un-folded position.
FIG. 3 is a front view of the golf club head groove cleaning tool of FIG. 1*a*, shown in a partially opened position.

Illustrated in the FIG. is a preferred foldable hand tool in accordance with the present invention for use as a golf club head groove cleaning tool. While this is a preferred embodiment, it is understood that the invention is not limited to such tool.

Referring to FIG. 1*a* and FIG. 1*b*, a preferred embodiment of a golf club head groove cleaning tool in accordance with the present invention is shown. FIG. 1*a* shows a perspective view of the device in the closed or folded position. FIG. 1*b* shows a perspective view of the device in the open or unfolded position.

The tool 10 comprises a first section 14 having a first inner side 25 and a second section 16 having a second inner side 28. A connector section 33 connects to the first section 14 and the second section 16. The connector section 33 is pivotably connected to the first section 14 at a first connection point 34, and pivotably connected to the second section 16 at a second connection point 35. As shown, the first connection point 34 and the second connection point 35 are spaced from one another such that the first inner side 25 of said first section 14 is capable of contacting the second inner side 28 of said second section 16 when the tool 10 is folded into the closed position as shown in FIG. 1*a*.

The tool 10 is for clearing dirt and debris from the grooves on the club head face. It also may be used to recondition worn grooves to restore them to their original condition.

The tool 10 in accordance with the present invention has two primary positions, folded (closed) and unfolded (open). This closed configuration is used to store and transport the tool 10 when it is not in use. The tool 10 is used to clean and recondition the grooves on the face of a golf club in the unfolded or open configuration.

In the unfolded configuration as shown in FIG. 1*b*, the first section 14 and the second section 16 are aligned to form a straight handle 12 by which the one holds the device during operation. Preferably, the first section 14 and the second section 16 are formed out of a readily machinable metal such as aluminum; however, the invention is not limited to an aluminum structure and may be made of other materials suitable for the particular use, including thermoplastics and ceramic materials. When in the unfolded position, the handle 12 is approximately twice the length of each of the respective first and second sections (14,16). This relationship allows for the tool to be compact in the folded configuration, and still allows for the handle 12 to be long enough to be easily gripped by the operator in the unfolded configuration. In a preferred embodiment, each of the first and second sections (14, 16) are approximately 2 inches in length, creating a tool that is approximately 4 inches in length in the unfolded configuration. However, it is understood that the invention could be practiced with sections of other lengths.

A protruding member 20 resides at an end of first section 14 for insertion into the grooves as described below. The protruding member 20, when configured as a blade as shown for reconditioning a groove in addition to cleaning a groove, can be formed of a high strength material such as carbide, carbide tipped stainless steel, or other hard material such as stainless steel. As shown in FIG. 1*b*, the protruding member 20 is fixably mounted in the first section 14 in a slot 22 that is machined in the first section 14. The protruding member 20 can be mounted in the first section 14 using any well known technique, such as using an epoxy or other mounting adhesives, or alternatively by spot welding, pressure fitting, etc. The protruding member comprises a straight section 21 which fits in the machined slot 22 of the first section 14 and an extending portion 23 that extends outward from a first inner side 25 of the first section 14. The first inner side 25 is the side that will contact a second inner side 28 of the second section 16 when the device is in the folded position.

Referring to FIG. 3, the extending portion 23 of the protruding member 20 is angled along one end to result in a point 27. The point 27 is the portion of the device that will lead the protruding member 20 during the cleaning or reconditioning of a groove on a golf club head. The exposed side 29 of the protruding member 20 is tapered on an angle, as shown at A in FIG. 3. Preferably, the width of the protruding member 20 at the exposed side 29 is approximately .020 inch. This allows the exposed side 29 of the protruding member 20 to be sufficiently narrow to fit in the groove of a golf club head. The protruding member 20 is tapered outward from the exposed side 29 to the straight section 21, as shown at B in FIG. 1*b*. Preferably, the protruding member 20 is tapered from the exposed side 29 width of .020 inch to a total width of .060 inch at the point where the extending portion 23 meets the straight portion 21.

When the device is operated, the first section 14 and the second section 16 are unfolded (as shown in FIG. 1*b*) to from a straight member handle that can be gripped by the user. The unfolded tool is held by the user along the first section 14 and the second section 16, and the extending portion 23 of the protruding member 20 is inserted into a groove on the golf club head. The groove is cleaned or reconditioned by gently passing the tool across the club head face with the point 27 of the extending portion 23 inserted in a groove as necessary until any dirt or debris is removed, or, if reconditioning of the groove is desired, until the groove has been re-cut or reconditioned as desired.

Referring again to FIG. 1*b*, the first section 14 and the second section 16 are joined using a connector section 33. The first section 14 is connected at the first connection point 34 by a pin 34*a* and the second section 16 is connected at the second connection point 35 by a pin 35*a* to pivotably connect each section to the connector section. Preferably, the pins 34*a*, 35*a* are formed using spring steel, i.e., spring pins which are compressed for insertion and which expand to maintain the hinged connections once in place. The connector section resides in a slot 37, 38 formed respectively in each of the first and second sections 14, 16. The connector section 33 and respective 37, 38 slot are configured to form an interference or tight fit such that the position of the device 10 can be manually adjusted, but the device tends to remain in the position in which it is placed until force is applied to move the first and second sections 14, 16 to a different position. This prevents the tool from opening unintentionally and exposing the protruding member 20 when it is not in use.

An alignment member 13 is attached to the second section 16. When the tool is in the folded position, the alignment member 13 cooperates with a corresponding recess 15 in the first section 14. The interaction of the alignment member and the recess act to align the tool when it is closed. As shown in FIG. 3, when the tool is being closed, the second section 16 is rotated towards the first section 14. The alignment member 13 will fit into the recess 15 when the tool is properly aligned in the closed position. This assures the protruding member 20 is properly seated in the slot 36 of the second section 16. Even where the two sections 14, 16 are initially misaligned, the alignment member 13 in cooperation with the recess 15 will move the two sections 14, 16 into alignment as the user closes the tool 10. In the preferred embodiment, the alignment member 13 is cylindrical in shape, and the corresponding recess 15 is cylindrical in shape as shown. The rounded nature of the these features causes the tool to be guided into the proper alignment position during folding. The cylindrical alignment member 13 is held in place on the second section 16 by the cutout 16*a* in which it rests. The cutout 16*a* forms a semi-circle slightly larger circumferentially than a half circle, thereby preventing the member 13 from falling out (upwards in FIG. 1*b*). An epoxy or other means can be used to prevent the member 13 from moving sideways out of the cutout 16*a* as seen in FIG. 1*b*.

Referring to FIG. 2, in the folded position, the protruding member 20 is completely encapsulated in the slot 36 of the second section 16. The alignment member 13 on the second section 16 resides in the recess 15 on the first section 14. In this folded configuration, the tool can be easily transported in the pocket or golf bag of the golfer. There are no sharp edges to catch on the any material in the pocket or golf bag, and the protruding member 20 is completely protected from the outside surroundings to insure that it does not cause any unwanted damage.

The tool in accordance with the present invention provides a compact, portable device that can be used to efficiently maintain the desired condition of the face of a golf club. It can be easily carried on the person or in the bag of the golfer, and does not present a risk of damage to the golf bag or the golfer's pocket. The present invention provides a simple, compact, and efficient means to enable golfers to keep their equipment in top condition.

It should be understood that the foregoing is illustrative and not limiting and that obvious modifications may be made by those skilled in the art without departing from the spirit of the invention. Accordingly, the specification is intended to cover such alternatives, modifications, and equivalence as may be included within the spirit and scope of the invention as defined in the following claims.

What is claimed is:

1. A foldable hand tool having an open position and a closed position, comprising:

a first section having a first inner side that is contoured to define an alignment member; and a second section having a second inner side that is contoured complementarily to said first inner side to define a recess for receiving said alignment member; and a connector section, said connector section connected pivotably to said first section at a first connection point, and said connector section connected pivotably to said second section at a second connection point, wherein said first connection point and said second connection point are spaced from one another and positioned such that substantially all of said first inner side of said first section contacts said second inner side of said second section when said tool is in the closed position, respective contours of said first and second inner sides cooperating to align said first and said second sections as the tool is moved into the closed position, said alignment member cooperating with and abutting said recess to ensure proper alignment of said first section and said second section when the device is in the closed position.

2. A tool as set forth in claim 1, further comprising:

a protruding member affixed to said first section.

3. A tool as set forth in claim 2, wherein said protruding member is completely encapsulated in the closed position.

4. A tool as set forth in claim 2 wherein said protruding member comprises a blade.

5. A tool as set forth in claim 4, wherein the blade is tapered from a distal point disposed proximally to the connection point on the first section, to a proximal end disposed distally to the connection point on the first section.

6. A tool as set forth in claim 1, wherein the tool is a device for cleaning and reconditioning grooves on a golf club head.

7. A tool as set forth in claim 1, wherein said first section and said second section are each approximately 2 inches in length.

8. A tool as set forth in claim 1, wherein said first, second and connector sections are configured to limit pivoting from said closed position, in which said first and second sections are substantially parallel, to an open position in which said first and second sections are aligned to form a straight handle.

9. A foldable hand tool having an open position and a closed position, comprising:

a first section having a first inner side;

a second section having a second inner side;

a connector section, said connector section connected pivotably to said first section at a first connection point, and said connector section connected pivotably to said second section at a second connection point, wherein said first connection point and said second connection point are spaced from one another and positioned such that said first inner side of said first section is capable of contacting said second inner side of said second section when said tool is in the closed position;

an alignment member affixed to one of said first and second sections; and a recess in the other of said one of said first and second sections, wherein said alignment member cooperates with and abuts said recess to ensure proper alignment of said first section and said second section when the device is in the closed position.

10. A tool as set forth in claim 9, wherein said alignment member and said recess are cylindrical in shape.

11. A foldable hand tool having an open position and a closed position, comprising:

a first section having a first inner side;

a second section having a second inner side; and a connector section, said connector section connected pivotably to said first section at a first connection point, and said connector section connected pivotably to said second section at a second connection point, wherein said first connection point and said second connection point are spaced from one another and positioned such that said first inner side of said first section is capable of contacting said second inner side of said second section when said tool is in the closed position;

an alignment member affixed to one of said first and second sections; and a recess in the other of said one of said first and second sections, wherein said recess cooperates with said alignment member to ensure proper alignment of said first section and said second section when the device is in the closed position. said alignment member and said recess are cylindrical in shape, said cylindrical alignment member being attached to said tool by a corresponding semi-circular slot disposed in said one of said first and second sections, said slot being slightly larger circumferentially than a half circle so as to maintain said alignment member therein.

12. A tool as set forth in claim 11, wherein each of said recess and said alignment member is uniform in transverse cross-section along the direction in which it extends.

13. A tool as set forth in claim 11, wherein said first, second and connector sections are configured to limit pivoting from said closed position, in which said first and second sections are substantially parallel, to an open position in which said first and second sections are aligned to form a straight handle.

14. A tool as set forth in claim 11, wherein the blade is tapered from a distal point disposed proximally to the connection point on the first section, to a proximal end disposed distally to the connection point on the first section.

15. A foldable hand tool for cleaning grooves of golf clubs, said tool having an open position and a closed position, said tool comprising:

a first section having a first inner side;

a second section having a second inner side;

a rigid protruding member affixed to said first section;

a slot disposed in said second section and configured to receive said protruding member when said tool is in said closed position; and a connector section pivotably connecting said first section to said second section, said connector section being connected pivotably to said first section at a first pin opposite said protruding member, said connector section further being connected pivotably to said second section at a second pin opposite said slot, wherein said first pin and said second pin are spaced from one another and positioned such that said first inner side of said first section contacts and mates with said second inner side of said second section when said tool is in the closed position to ensure proper alignment of said first section and said second section when the device is in the closed position, and wherein said first, second and connector sections are configured to permit pivoting only between said closed position and an open position, said first and second sections being substantially parallel in said closed position, said first and second sections being aligned to form a straight handle in said open position.

16. A tool as set forth in claim 15 wherein said protruding member comprises a blade.

17. A tool as set forth in claim 16, wherein the blade is tapered from a distal point disposed proximally to the pin the first section, to a proximal end disposed distally to the pin on the first section.

18. A tool as set forth in claim 15, further comprising:

an alignment member affixed to one of said first and second sections; and a recess in the other of said one of said first and second sections;

wherein both of said recess and said alignment member extend in a direction perpendicular to a plane in which said first and second sections pivot, said recess being configured to intermesh with said alignment member to assure proper alignment of said first section and said second section in said plane to ensure receipt of said rigid protruding member by said slot when the tool is in the closed position.

19. A tool as set forth in claim 18, wherein said alignment member and said recess are cylindrical in shape, and said alignment member is capable of being seated, at least partially, into said recess when said tool is closed.

20. A tool as set forth in claim 18, wherein each of said recess and said alignment member is uniform in transverse cross-section along the direction in which it extends.

* * * * *